United States Patent [19]

Kojima et al.

[11] Patent Number: 5,059,502

[45] Date of Patent: Oct. 22, 1991

[54] ELECTROPHOTOGRAPHIC PHOTOCONDUCTOR

[75] Inventors: Narihito Kojima; Hiroshi Nagame, both of Numazu; Mitsuru Seto, Yamakita; Shunpei Yamazaki, Atsugi; Shigenori Hayashi, Atsugi; Noriya Ishida, Atsugi; Naoki Hirose, Atsugi; Mari Sasaki, Atsugi; Junichi Takeyama, Atsugi, all of Japan

[73] Assignees: Ricoh Company, Ltd., Tokyo; Semiconductor Energy Laboratory Company Co., Ltd., Atsugi, both of Japan

[21] Appl. No.: 434,783

[22] Filed: Nov. 13, 1989

[30] Foreign Application Priority Data

Nov. 13, 1988 [JP] Japan ..... 63-286507
Feb. 10, 1989 [JP] Japan ..... 01-032218

[51] Int. Cl.[5] ..... G03G 5/147
[52] U.S. Cl. ..... 430/66; 430/67
[58] Field of Search ..... 430/65, 67, 66, 132

[56] References Cited

U.S. PATENT DOCUMENTS 4,868,078 9/1989 Sakai et al. ..... 430/67
4,886,724 12/1989 Masaki et al. ..... 430/66
4,902,595 2/1990 Masaki et al. ..... 430/66

*Primary Examiner*—John Goodrow
*Attorney, Agent, or Firm*—Oblon, Spivak, McClelland, Maier & Neustadt

[57] ABSTRACT

An electrophotographic photoconductor comprises an electroconductive substrate, an organic photoconductive layer formed on the electroconductive substrate, and a protective layer formed on the organic photoconductive layer, comprising carbon or a carbon-based material as its main component, in which the difference in the Vickers hardness between the organic photoconductive layer and the protective layer is 2500 $Kg/mm^2$ or less, and the oxygen concentration at the interface or in the vicinity of the interface between the organic photoconductive layer and the protective layer is 1 atom % or less.

24 Claims, 3 Drawing Sheets

ELECTROPHOTOGRAPHIC PHOTOCONDUCTOR

BACKGROUND OF THE INVENTION

1. Field of the Invention

This invention relates to an electrophotographic photoconductor comprising an organic photoconductive layer, and a protective layer formed thereon, which comprises carbon or a carbon-based material as its main component.

2. Discussion of Background

Heretofore, the following photoconductors have been generally used for electrophotography: a photoconductor in which a conductive substrate is provided with a photoconductive layer comprising a the main component selenium or its alloy, a photoconductor comprising a photoconductive layer in which an inorganic photoconductive material such as zinc oxide or cadmium sulfate is dispersed in a binder agent, a photoconductor comprising a photoconductive layer which contains polyvinyl-N-carbazole and an organic photoconductive material such as trinitrofluorenone or an azo pigment, and a photoconductor comprising a photoconductive layer made of an amorphous silicon material.

The electrophotography is one of image-reproducing methods. According to this method, a photoconductive layer of a photoconductor is electrically charged in the dark, for instance, by a corona charge, and an optical image is exposed thereto. During exposure to the image, electrical conductivity is produced within the photoconductive layer in the areas where light impinges upon the photoconductive layer. This causes dissipation of the surface charges in these areas due to conduction through the photoconductive layer to a substrate on which the photoconductive layer is formed. The electrostatic latent image thus obtained is developed with charge detective finely-divided particles, a toner, composed of a coloring agent such as a dye or a pigment and a binder agent made of polymeric material. Thus, a visible image can be obtained.

Basic characteristics required for the photoconductor for use in the electrophotography are as follows:

(1) the photoconductor is chargeable with a predetermined surface potential in the dark;

(2) the photoconductor dissipates only a few electric charges in the dark; and (3) the photoconductor promptly dissipates electric charges when it is illuminated.

Among the previously mentioned photoconductors currently available, organic photoconductors are now attracting attention. This is because organic photoconductors can be produced at low production cost, and cause little air pollution. In addition, the organic materials allow relatively free designing for preparing photoconductors.

In general, a dispersion or a solution prepared by dispersing o dissolving a charge generating material and a charge transporting material in a binder resin is coated onto an electroconductive substrate to form a photoconductive layer, thereby obtaining an organic photoconductor.

The photoconductive layers are classified into two types, a single-layer type and a function-separated type.

A photoconductive layer of the single-layer type fulfills the charge retaining, charge generating and charge transporting functions by itself. A photoconductive layer of the function-separated type, on the other hand, is composed of some layers such as a charge generating layer which generates electric charges, a charge transporting layer which retains charges and transports the electric charges generated by the charge generating layer, and, if necessary, a layer which hinders electric charges to invade from the substrate, or a layer which prevents the substrate from reflecting light.

The organic photoconductors have, as described above, excellent characteristics. However, their surfaces have low hardness, so that they are easily worn away or scratched when they are brought into contact with a developer, a copying paper or a cleaning member of a copying machine in the course of the reproduction process.

The life span of the photoconductor is undoubtedly shortened by the worn or scratched photoconductive layer. This is because the worn photoconductive layer decreases charged potential, and the scratched one produces offensive line images.

In order to eliminate the above disadvantages inherent in the organic photoconductors, a protective layer with which the organic photoconductive layer is covered has been proposed. The protective layer protects the organic photoconductive layer from undergoing mechanical damages, so that the durability of the photoconductor can be improved. Examples are as follows:

A photoconductive layer covered with an organic film as disclosed in Japanese Patent Publication 38-015446, a photoconductive layer covered with a layer made of an inorganic acid compound as disclosed in Japanese Patent Publication 43-014517, a photoconductive layer on which an insulating layer is overlaid through an adhesive layer as disclosed in Japanese Patent Publication 43-027591, and a photoconductive layer on which an a-Si layer, an s-Si:N:H layer or an a-Si:0:H layer is overlaid by means of plasma CVD or photo CVD as disclosed in Japanese Laid-Open Patent Applications 57-179859 and 59-058437.

In addition, intensive studies are now being made into application of a diamond-like carbon film with high hardness to the protective layer. Examples are as follows:

A photoconductive layer covered with a protective layer made of an amorphous carbon or a hardened carbon material as disclosed in Japanese Laid-Open Patent Application 60-249155, a photoconductive layer covered with a protective layer made of a diamond-like carbon as disclosed in Japanese Laid-Open Patent Application 61-255352, a photoconductive layer covered with an insulating layer having high hardness made of a carbon-based material as disclosed in Japanese Laid-Open Patent Application 61-264355, an organic photoconductive layer covered with a protective layer made of a plasma-polymerized film which at least contains atoms of nitrogen, oxygen, a halogen or an alkaline metal as disclosed in Japanese Laid-Open Patent Applications 63-97961, 63-97962, 63-97963 and 63-97964, and an organic photoconductive layer covered with a protective layer made of an amorphous hydrocarbon film formed by a glow discharge, at least containing a chalcogen atom, an atom belonging to the III group, an atom belonging to the IV group or an atom belonging to the V group as disclosed in Japanese Laid-Open Patent Applications 63-220166, 63-220167, 63-220168 and 63-220169.

In the above all proposals, a thin film made of a carbon-based material with high hardness, which is generally referred to as an i-carbon film or a diamond-like carbon film, is formed on the surface of an organic photoconductive layer by means of an ion process such as sputtering, plasma CVD, glow discharge decomposition or photo CVD.

The surface of the organic photoconductive layer can thus be reinforced, and the durability of the photoconductor is successfully improved.

However, in the case where an excessively hard protective layer is formed on an organic photoconductive layer having a low Vickers hardness of approximately 20 Kg/mm$^2$, sufficient adhesion cannot be obtained between the protective layer and the photoconductive layer. Such a weak adhesion brings about exfoliation of the protective layer at the interface between the protective layer and the photoconductive layer when the photoconductor is practically used. It has thus been found that there is still room for improvement in the durability of the photoconductor.

SUMMARY OF THE INVENTION

Accordingly, it is an object of the present invention to provide an electrophotographic photoconductor comprising an organic photoconductive layer and a protective layer made of carbon or a carbon-based material, in which the protective layer neither peels off the photoconductive layer nor is cracked and imparts high durability to the photoconductor.

The object of the present invention can be attained by an electrophotographic photoconductor comprising an electroconductive substrate, an organic photoconductive layer formed on the substrate, and a protective layer formed on the photoconductive layer, which comprises carbon or a carbon-based material as its main component, the difference between the Vickers hardness of the protective layer and that of the organic photoconductive layer being 2500 Kg/mm$^2$ or less.

The electrophotographic photoconductor according to the present invention can further comprise an intermediate layer interposed between the organic photoconductive layer and the protective layer, if necessary.

It is preferable to control the oxygen concentration to 1 atom% or less at the interface or in the vicinity of the interface between the organic photoconductive layer and the protective layer, or between the intermediate layer and the protective layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
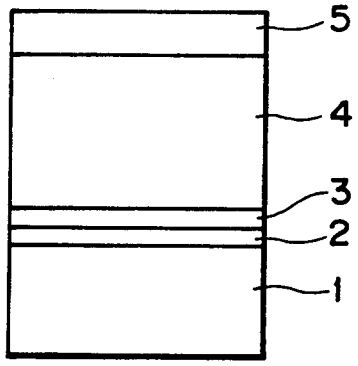
FIG. 1 is a cross-sectional view of an electrophotographic photoconductor according to the present invention.

In general, the durability of a photoconductor in which an organic photoconductive layer is covered with a protective layer greatly depends on the mechanical strength, especially the hardness, of the protective layer. Therefore, theoretically, it is desirable that the hardness of the protective layer be as high as possible.

However, the inventors of the present invention have found that the protective layer comprising carbon or a carbon-based material as its main component unexpectedly peels of the organic photoconductive layer, and is also cracked when the hardness of the protective layer is extremely high. It has thus been found that the durability of the photoconductor cannot be improved forming an excessively hard protective layer on the organic photoconductive layer.

Studies have been further made into the causes for the above phenomenon. As a result, it has been found that when the protective layer having extremely high hardness is formed on the organic photoconductive layer having a low Vickers hardness of approximately 20 Kg/mm$^2$, the mechanical stress applied to the protective layer is higher than the adhesion between the organic photoconductive layer and the protective layer.

It has also been found that when the difference between the Vickers hardness of the organic photoconductive layer and that of the protective layer, $\Delta$Hv, is 2500 Kg/mm$^2$ or less, the adhesion between the organic photoconductive layer and the protective layer is higher than the mechanical stress applied to the protective layer. Therefore, the above problems can be solved by controlling $\Delta$Hv in the above range, and a highly durable electrophotographic photoconductor can be obtained. The present invention has been accomplished based on the above finding.

Namely, the present invention is characterized in that the difference between the Vickers hardness of the organic photoconductive layer and that of the protective layer, $\Delta$Hv, is 2500 Kg/mm$^2$ or less, preferably 2000 Kg/mm$^2$ or less.

When $\Delta$Hv exceeds 2500 Kg/mm$^2$, the protective layer produces cracks on its surface and peels off the photoconductive layer at its circumference, so that the object of the present invention cannot be attained.

The Vickers hardness of the organic photoconductive layer and that of the protective can be freely determined within the above-described range. In general, however, the Vickers hardness of the organic photoconductive layer, Hv (I), is 10 to 100 Kg/mm$^2$, preferably 10 to 50 Kg/mm$^2$, and that of the protective layer, Hv (II), is 100 to 2500 Kg/mm$^2$, preferably 500 to 2000 Kg/mm$^2$.

The inventors of the present invention have also made studies into the improvement in the adhesion properties between the organic photoconductive layer and the protective layer comprising carbon or a carbon-based material as its main component. In the course of the above studies, it has been confirmed by the Auger electron spectroscopic analysis that the outermost surface of the organic photoconductive layer contains 6 to 36 atom% of oxygen, and this oxygen concentration is reduced to 1/6 or less at the depth ranging from 100 to 1000 Å of the photoconductive layer.

It has been finally found that the adhesion properties between these two layers can be remarkably improved by removing the oxygen atoms attached to or adsorbed by the surface of the organic photoconductive layer. The oxygen atoms can be removed by subjecting the surface of the organic photoconductive layer to the plasma treatment using $H_2$, $N_2$ or Ar, or to the heating treatment. It has been confirmed that not more than 1 atom% of oxygen atom, the lowest limit of the oxygen concentration which can be determined by the Auger electron spectroscopic analysis, exists at the interface between the above-treated organic photoconductive layer and the protective layer.

Note that the effect of the plasma treatment using the plasma of $H_2$, $N_2$ or Ar is ensured when a bias is applied to the organic photoconductive layer under the electric field of 1 to 500 KHz provided by an electric source which is different from the exciting source for generating the plasma.

Therefore, in the electrophotographic photoconductor according to the present invention, it is preferable to control the oxygen concentration to 1 atom% or less at the interface or in the vicinity of the interface between the organic photoconductive layer and the protective layer, or between the intermediate layer and the protective layer.

Referring now to the accompanying drawings, the present invention will be explained in greater detail.

FIG. 1 is a cross-sectional view of the electrophotographic photoconductor according to the present invention. In this photoconductor, an undercoat layer 2, a charge generating layer 3, a charge transporting layer 4 and a protective layer 5 are successively overlaid in this order on an electroconductive substrate 1.

Figure 2A:
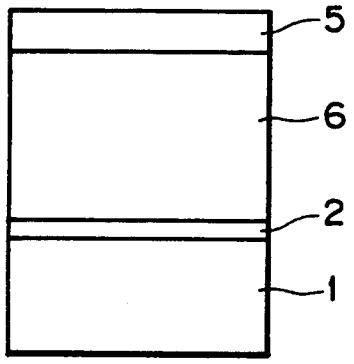
FIGS. 2(*a*) and (*b*) are cross-sectional views of alternative embodiments of the present invention.
Figure 2B:
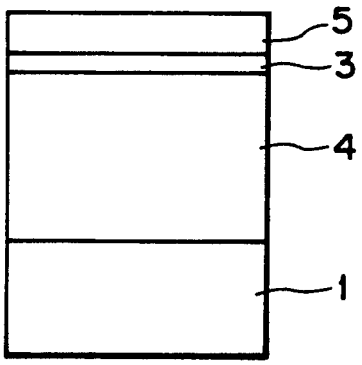

FIGS. 2(*a*) and 2(*b*) are cross-sectional views of the alternative embodiments of the present invention.

In the electrophotographic photoconductor shown in FIG. 2(*a*), an organic photoconductive layer 6 of a single-layer type is overlaid on an electroconductive substrate 1 through an undercoat layer 2, and a protective layer 5 is formed on the photoconductive layer 6.

In the photoconductor shown in FIG. 2(*b*), a charge transporting layer 4 is directly overlaid on an electroconductive substrate 1, and a charge generating layer 3 and a protective layer 5 are successively overlaid on the charge transporting layer 4 in this order.

Electroconductive materials, for example, metals such as Al, Ni, Fe, Cu and Au, and alloys thereof; insulators, such as polyester, polycarbonate, polyimide and glass, covered with a thin film of an electroconductive material such as Al, Ag, Au, $In_2O_3$ and $SuO_2$; and paper coated with an electroconductive material can be used as an electroconductive substrate in the present invention.

There is no particular limitation on the shape of the electroconductive substrate, and any shapes such as plate, drum and belt are acceptable.

An undercoat layer which can be, if necessary, interposed between the electroconductive substrate and the photoconductive layer enhances the effect of the present invention, and also strengthens the adhesion between the electroconductive substrate and the photoconductive layer.

Examples of the materials used for the undercoat layer include inorganic materials such as SiO, $Al_2O_3$, organic coupling agents such as a silane coupling agent, a titanium coupling agent and chromium coupling agent, and resins which are highly compatible with both the electroconductive substrate and the photoconductive layer, such as polyamide resin, alcohol-soluble polyamide resin, water-soluble polyvinyl butyral, polyvinyl butyral and polyvinyl acetate.

In addition to the above, ZnO, $TiO_2$ or ZnS can be dispersed into the above resin.

The undercoat layer can be formed by sputtering or vapor deposition when one of the above-described inorganic materials is solely used, and by coating when the above organic material is employed. The thickness of the undercoat layer is preferably 5 μm or less.

As the organic photoconductive layer formed directly on the electroconductive substrate or formed on the electroconductive substrate through the undercoat layer, either a single-layer type or a function-separated type can be used as long as the Vickers hardness falls within the previously mentioned range.

The photoconductive layers of the single-layer type which can be employed in the present invention are as follows:

A photoconductive layer prepared by coating, onto the electroconductive substrate, photoconductive powder of color-sensitized zinc oxide, titanium oxide or zinc sulfate, selenium powder, amorphous silicon powder, a squalic salt pigment, a phthalocyanine pigment, an azulenium salt pigment or an azo pigment, if necessary, together with a binder resin and/or an electron doner type compound which will be described later; and a photoconductive layer prepared by using a mixture of an eutectic crystal composed of a pyrylium dye and polycarbonate of a bisphenol A type, and an electron doner type compound.

Any binder resins usable for the function-separated-type photoconductive layer, which will be described later in this Specification, can be used for forming the single-layer-type photoconductive layer. The thickness of the single-layer-type photoconductive layer is preferably 5 to 30 μm.

Regarding the function-separated-type photoconductive layer, the combination of a charge generating layer and a charge transporting layer is the most typical.

The charge generating layer is formed using a dispersion or a solution which is prepared by dispersing or dissolving inorganic photoconducitve powder such as crystalline selenium or arsenic selenide or an organic dye or pigment in a binder resin.

Specific examples of the organic dye or pigment for use in the charge generating layer are as follows:

C.I. Pigment Blue 25 (C.I. 21180), C.I. Pigment Red 41 (C.I. 21200), C.I. Acid Red 52 (C.I. 45100), and C.I. Basic Red 3 (C.I. 45210); phthalocyanine type pigments having a polyphyline structure, azulenium salt pigments, squalic salt pigments, azo pigments having a carbazole structure as disclosed in Japanese Laid-Open Patent Application 53-95033, azo pigments having a styrylstilbene structure as disclosed in Japanese Laid-Open Patent Application 53-138229, azo plgments having a triphenylamine structure as disclosed in Japanese Laid-Open Patent Application 53-132547, azo pigments having a dibenzothiophene structure as disclosed in Japanese Laid-Open Patent Application 54-21728, azo pigments having an oxadiazole structure as disclosed in Japanese Laid-Open Patent Application 54-12742, azo pigments having a fluorenone structure as disclosed in Japanese Laid-Open Patent Application 54-22834, azo pigments having a bisstilbene structure as disclosed in Japanese Laid-Open Patent Application 54-17733, azo pigments having a distyryl oxadiazole structure as disclosed in Japanese Laid-Open Patent Application 54-2129, azo pigments having a distyryl carbazole structure as disclosed in Japanese Laid-Open Patent Application 54-17734, triazo pigments having a carbazole structure as disclosed in Japanese Laid-Open Patent Applications 57-195767 and 57-195768, phthalocyanine type pigments such as C.I. Pigment Blue 16 (C.I. 74100), indigo type pigments such as C.I. Vat Brown 5 (C.I. 73410) and C.I. Vat Dye (C.I. 73030), and perylene type pigments such as Algol Scarlet B (made by Violet Ltd.) and Indanthrene Scarlet R (made by Bayer Co., Ltd.).

The above charge generating materials are used either singly or in combination.

The following adhesive and insulating materials can be used as a binder resin for preparing, together with the above organic dye or pigment, the function-separated-type photoconductive layer: condensed polymer resins such as polyamide, polyurethane, polyester, epoxy resin, polycarbonate and polyether, polymers such as polystyrene, polyacryrate, polymethacrylate, poly-N-vinylcarbazole, polyvinylbutyral, and copolymers such as a styrene-butadiene copolymer and a styrene-acrylonitrile copolymer.

The amount of the binder resin is 0 to 100 parts by weight, preferably 0 to 50 parts by weight, per 100 parts by weight of the charge generating material.

The charge generating layer is formed by the following procedure: the charge generating material is dispersed, if necessary, together with the binder resin, in a solvent such as tetrahydrofuran, cyclohexane, dioxane or dichloroethane using a ball mill, an attritor or a sand mill. The resulting dispersion is coated onto the electroconductive substrate by dip coating, spray coating or bead coating.

The thickness of the charge generating layer is 0.01 to 5 μm, preferably 0.1 to 2 μm.

In the case where particles of crystalline selenium or arsenic selenide are used as the charge generating material, a charge doner type binder agent and/or a charge doner type organic compound is co-employed.

Examples of the charge doner type materials include polyvinyl carbazole and its derivatives having a halogen such as chlorine or bromine, a methyl group or an amino group as a substituent, polyvinyl pyrene, oxadiazole, pyrazoline, hydrazone, diarylmethane, α-phenylstilbene, nitrogen-containing compounds such as a triphenyl amine compounds, and diarylmethane compound. Of these, polyvinyl carbazole and its derivatives are preferred.

The above charge doner type materials are used either singly or in combination. When they are used in combination, the combined use of polyvinyl carbazole or its derivative and other charge doner type organic material is preferred. In this case, the charge doner type organic material is incorporated into polyvinyl carbazole or its derivative in advance.

The amount of the inorganic charge generating material is 30 to 90 wt% of the total weight of the charge generating layer. The thickness of the charge generating layer prepared using the inorganic charge generating material is preferably 0.2 to 5 μm.

The charge transporting layer serves as follows. Namely, it retains charges, and transports the electrical charges which are generated and released by the charge generating layer. Thus, the charges retained in the charge transporting layer and the electrical charges released by the charge generating layer are combined with each other.

The charge transporting layer is, therefore, required to have high electric resistance for successfully retaining electric charges, low dielectric constant and high charge transporting ability for attaining a high surface potential produced by the retained charges.

The charge transporting layer is prepared using a charge transporting material and, if necessary, a binder resin.

The charge transporting layer is formed by the following procedure. The charge transporting material is dissolved or dispersed in a solvent, if necessary, together with the binder resin. The resulting dispersion or solution is coated onto the charge generating layer, and then dried.

The charge transporting materials are classified into two types; a positive hole transporting material and an electron transporting material.

The following electron donor type materials are used as the positive hole transporting material: poly-N-vinylcarbazole and derivatives thereof, poly-γ-carbazolyl ethylglutamate and derivatives thereof, condensation products of pyrene and formaldehyde and derivatives thereof, polyvinyl pyrene, polyvinyl phenanthrene, oxazole derivatives, oxadiazole derivatives, imidazole derivatives, triphenylamine derivatives, 9-(p-diethylaminostyryl)anthracene, 1,1-bis-(4-dibenzylaminophenyl)propane, styrylanthracene, styrylpyrazoline, phenylhydrozones and α-phenylstylbene derivatives.

On the other hand, the following electron acceptor type materials are used as the electron transporting material: chloranil, bromanil, tetracyanoethylene, tetracyanoquinone dimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-4H-indeno[1,2-b]-thiophenone-4-on, and 1,3,7-trinitrodibenzothiophenone-5,5-dioxide.

The above charge transporting materials are used either singly or in combination.

Examples of the binder resin used together with the charge transporting material when necessary include thermoplastic resins and thermosetting resins, such as polystyrene, styrene - acrylonitrile copolymers, styrene butadiene copolymers, styrene - maleic anhydride copolymers, polyester, polyvinylchloride, vinylchloride - vinylacetate copolymers, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin and alkyd resin.

Tetrahydrofuran, dioxane, toluene, monochlorobenzene, dichloroethane or methylene chloride is used as the solvent in which the charge transporting material is dissolved or dispersed.

The thickness of the charge transporting layer is preferably 5 to 100 μm.

Furthermore, auxiliary compounds such as a plasticizer and a leveling agent may be incorporated into the charge transporting layer.

Any known plasticizers such as dibutylphthalate and dioctylphthalate can be used as the plasticizer in the present invention. The amount of the plasticizer is 0 to 30 parts by weight per 100 parts by weight of the binder resin.

As the leveling agent, silicone oils such as dimethyl silicone oil and methylphenyl silicone oil can be used. The amount of the leveling agent is 0 to 1 part by weight per 100 parts by weight of the binder resin.

In the above description, the charge generating layer and the charge transporting layer are overlaid on the electroconductive substrate in this order. This order, however, can be reversed.

Any carbon or carbon-based materials can be used for preparing the protective layer as long as they have the Vickers hardness of 100 to 2500 Kg/mm$^2$, preferably 500 to 2000 Kg/mm$^2$. The preferable protective layer, however, is a thin film made of carbon or a carbon-based material which has the C—C bond analogous to that of diamond having the $SP^3$ orbit, having a specific resistance (resistivity) of $1\times10^7$ to $1\times10^{13}$ Ω·cm, and an optical energy band width of 1.0 eV or more, and capable of transmitting infrared and visible light.

The protective layer can be prepared by any one of the known methods such as sputtering, plasma CVD, glow discharge decomposition and light CVD. However, the most preferable method is the combination of plasma CVD and sputtering. This method is disclosed in Japanese Laid-Open Patent Application 58-49609, applied by the inventors of the present invention.

According to this method, a substrate is placed on an electrode on the cathode side in a plasma CVD apparatus of the parallel - flat type, and the desired material is deposited on the surface of the substrate by applying an auto-bias. A carbon film with high hardness can be obtained by strongly exciting the active seed by the micro-wave exciting method.

The above method is conveniently employed when the substrate is a sheet in shape. However, in the case where the apparatus for plasma CVD as shown in FIG. 3 is used, any substrates can be used irrespective of their shape.

Figure 3:
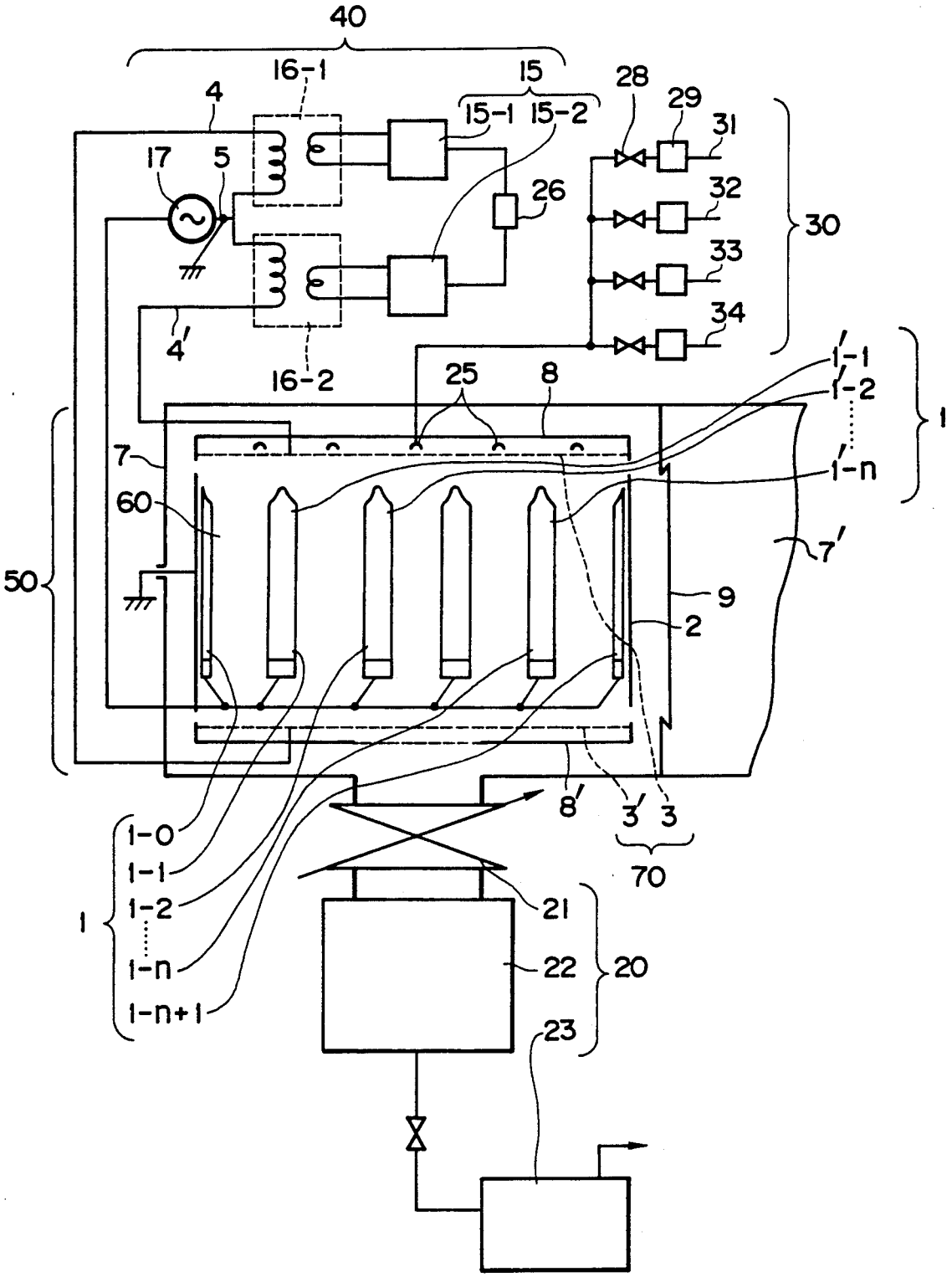
FIG. 3 is a schematic illustration of an apparatus for plasma CVD used for the formation of the protective layer in the present invention.

In the apparatus shown in FIG. 3, a reaction vessel 7 and a preliminary chamber 7' for load and unload are separated from each other by a gate valve 9. In a gas system 30, a carrier gas, a reaction gas, an additional gas, a gas for etching are introduced into a reaction system 50 from 31, 32, 33 and 34, respectively, via valves 28 and flow meters 29. The flow of these gases is controlled by nozzles 25.

Figure 4A:
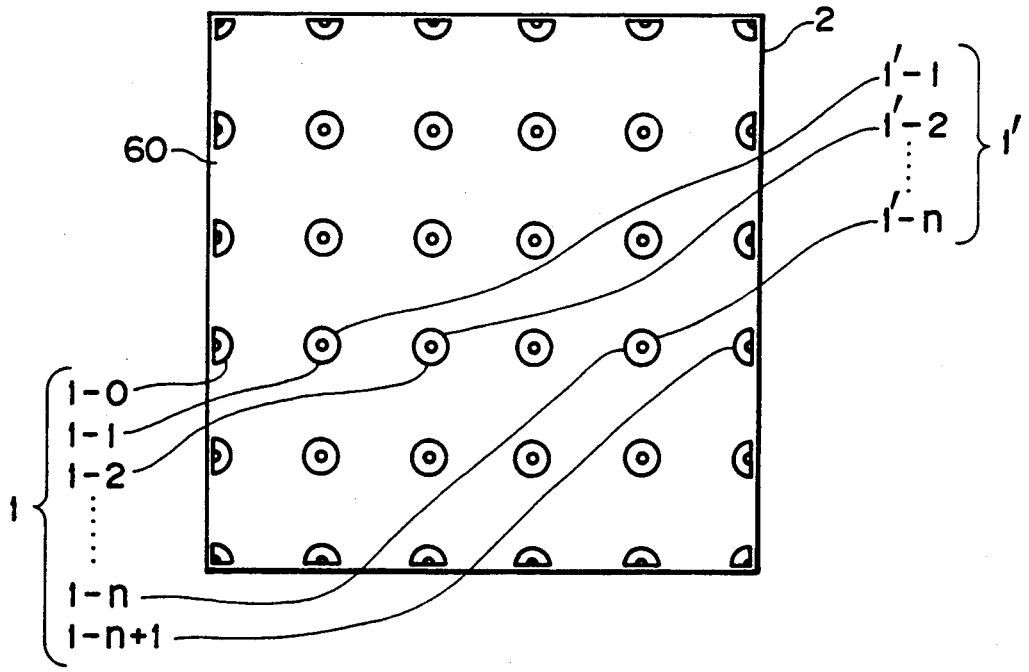
FIGS. 4(A) and (B) are plan views of the frameworks used for the apparatus for plasma CVD shown in FIG. 3.
Figure 4B:
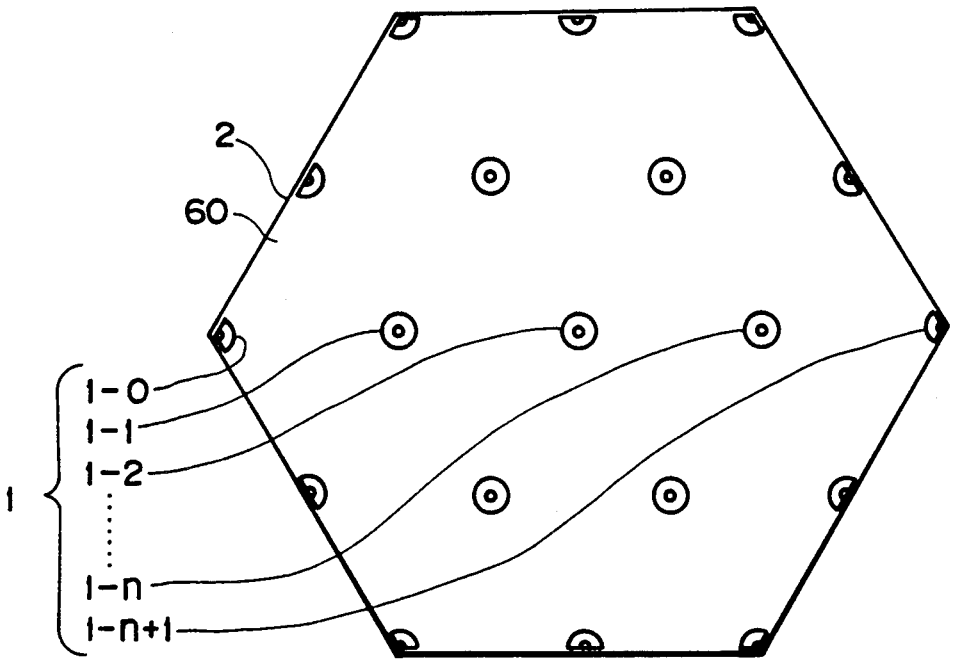

A reaction system 50 has a framework 2 as shown in FIGS. 4(A) or 4(B), and the upper and the lower openings of the framework are covered with hoods 8 and 8'. A first electrode 3 and a second electrode 3', which are made of aluminum mesh and have the identical shape, are arranged on the hoods 8 and 8'.

The reaction gas is discharged downward by the nozzle 25. A third electrode is an aluminum cylindrical substrate covered with an organic photoconductive layer. When a direct electric current is applied, the photoconductive layer serves as an insulating layer. However, the photoconductive layer practically serves as a conductive layer when the second alternating voltage is applied thereto. Therefore, a bias is applied to the photoconductive layer by the second alternating voltage.

The substrate 1 is arranged between a pair of the electrodes 3 and 3' so that its surface 1' can be exposed to the plasma generated by the electrodes. Practically, the substrate 1 is directed to a set of substrates 1-1, 1-2, 1-n, so that these substrates have the corresponding ....., surfaces 1'-1, 1'-2, ....., 1'-n. To these surfaces is applied an alternating voltage with a frequency of 1 to 500 KHz to which the second alternating voltage and a negative direct current bias is applied. The direct current bias is either an auto-bias which is accumulated by a source of the second alternating voltage in a condenser (not illustrated in the figure) arranged between the source of the second alternating voltage and the third electrode or the direct current bias applied by the source of the direct electric current.

The reaction gas is altered to plasma by a glow discharge caused by the first alternating voltage with high frequency. The plasma is homogeneously dispersed in a reaction space 60, and surrounded by the framework 2 and the foods 8 and 8' thereof. Thus, the plasma is prevented from running out to an outer space, and depositing on the inner surface of the reaction vessel. In addition, the plasma potential is made homogeneous in the reaction space.

In order to ensure the homogeneous distribution of the plasma potential in the reaction space, alternating voltages having two different frequencies are applied to an electric source system 40. The first alternating voltage has a high frequency between 1 and 100 MHz, and the electric current is derived from a pair of the electric sources 15-1 and 15-2 to matching transformers 16-1 and 16-2. The phase of the alternating voltage is adjusted at the matching transformers by a phase adjuster so that the voltage can be applied with a phase difference of 180° or 0°. The output voltage has a symmetrical or an identical wave pattern.

Ends 4 and 4' of the transformer are connected with the first and second electrodes 3 and 3', respectively. The transformer is earthed at the middle point 5 between the two ends 4 and 4', and a second alternating electric field of 1 to 500 KHz is applied by an alternating current source 17 to the transformer. The output of the current source 17 is connected through the condenser (not illustrate) with the substrates 1-1, 1-2, ....., 1-n, or the third electrode arranged in the holder 2 which is electrically connected with the substrates.

Plasma is thus generated in the reaction space 60. An exhausting system 20, which is composed of a pressure adjusting valve 21, a turbo molecular pump 22 and a rotary pump 23, exhausts unnecessary gas. The pressure of the reaction gas in the reaction space 60 is controlled to 0.001 to 1.0 Torr.

The framework 2 is square or hexagonal. The square framework shown in FIG. 4(A) has a width of 75 cm, a length of 50 cm, and a depth of 75 cm. The cylindrical substrates whose surfaces are brought into contact with this framework 2 are indicated by 1-1, 1-2, ....., 1-n, and, in this figure, 16 pieces of the substrates are arranged at regular intervals. In the outer space of the arrangement of these substrates, dummy substrates indicated by 1-0 and 1-n+1 are arranged so as to produce a uniform electric field.

In such a space, a first RF voltage having a high frequency of 1 to 100 MHz and an electric power of 0.5 to 5 KW (0.3 to 3 W/cm$^2$) is applied. Under such conditions, a negative auto-bias voltage of −10 to −600 V is applied to the surfaces of the substrates by the alternating bias which is generated by the second alternating voltage. The reaction gas accelerated by the negative auto-bias is sputtered on the substrates to form a thin film with a high density. The thickness of the film can be changed by controlling the negative auto-bias voltage applied. This is one of the characteristics of the carbon-film formation method employed in the present invention.

The output power of the first alternating voltage applied to the first and the second electrodes are 0.1 to 1 KW when the frequency is 13.56 MHz. The output power of the second alternating voltage applied to the third electrode is approximately 100 W when the frequency is 150 KHz.

In the above reaction, hydrogen or argon is used as the carrier gas; a hydrocarbon such as methane or ethylene, or a carbide gas such as carbon fluoride is used as the reaction gas; and a nitrite gas such as fluorine nitride or ammonium, $PH_3$, or $B_2H_6$ is employed as the additional gas. Furthermore, oxygen or fluoride gas such as nitrogen fluoride or carbon fluoride can be used as the etching gas.

In the case where ethylene, a reaction gas, is introduced into the reaction vessel together with nitrogen fluoride, an additional gas, a diamond-like carbon thin film containing nitrogen and fluorine is formed.

The typical gases used are ethylene and $NF_3$, and their mixing ratio is $NF_3/C_2H_4=1/20$–$4/1$. The reaction is carried out under the reduced pressure of 0.001 to 1.0 Torr.

In the above-described film-forming method, the physical properties of the film formed, such as the hardness, the transparency to light and the specific resistance, can be easily controlled by changing the conditions for the film formation such as the reaction pressure and the mixing ratio of the reaction gases. Especially, the hardness of the film can be freely changed by controlling the negative bias which is applied to the substrate, and the reaction pressure.

In addition, according to this film-forming temperature, it is not necessary to heat the substrate for forming a thin film of carbon or a carbon-based material. The film can be formed under a low temperature of 150° C. or less; in general, the substrate is maintained at room temperature. Therefore, the thin film serving as a protective layer can be formed on the organic photoconductive layer, which has low thermal resistance, without degenerating the photoconductive layer.

The above-obtained thin film has the C-C bond similar to that of diamond having the $SP^3$ orbital. The Vickers hardness, the specific resistance (resistivity), and the optical energy band width of the thin film is 100 to 3000 $Kg/mm^2$, $1\times10^7$ to $1\times10^{15}$ Ω·cm, and 1.0 eV or more, preferably 1.5 to 5.5 eV, respectively. In addition, the film is transparent to infrared and visible lights and has properties analogous to those of diamond.

A halogen such as fluorine, nitrogen, phosphorus or boron may be incorporated into the protective layer, if necessary. The content of such an additional component can be either homogeneous or gradient to the depth direction of the film.

The thickness of the protective layer employed in the present invention is 0.01 μm to 5 μm, preferably 0.1 μm to 2 μm, and its specific resistance is $1\times10^7$ to $1\times10^{13}$ Ω·cm, preferably $1\times10^9$ to $1\times10^{12}$ Ω·cm.

The protective layer can be composed of either a sole layer or multiple layers.

Other features of this invention will becoming apparent in the course of the following description of exemplary embodiments, which are given for illustration of the invention and are not intended to be limiting thereof.

EXAMPLE 1-1

[Formation of Undercoat Layer]

An undercoat layer having a thickness of approximately 2 μm was formed on an aluminum cylinder substrate which had an outer diameter of 40 mm and a length of 250 mm by the following procedure.

All the following components of a liquid for forming an undercoat layer were placed in a ball mill, and dispersed for 12 hours. The resulting dispersion was dip-coated onto the substrate to form the undercoat layer.

| | parts by weight |
|---|---|
| $TiO_2$ (Trademark "Tipaque", made by Ishihara Sangyo Kaisha, Ltd.) | 1 |
| Polyamide resin (Trademark "CM-8000", made by Toray Industries, Inc.) | 1 |
| Methanol | 25 |

[Formation of Charge Generating Layer ]

All the following components were placed in a ball mill, and dispersed for 72 hours. The resulting dispersion was diluted with 500 parts by weight of a 1:1 (weight basis) mixed solvent of cyclohexanone and methylethyl ketone, thereby obtaining a coating liquid for forming a charge generating layer.

The above-obtained coating liquid was coated onto the surface of the above-formed undercoat layer by dipping, and then dried at 120° C. for 10 minutes, whereby a charge generating layer having a thickness of approximately 0.15 μm was formed.

| | parts by weight |
|---|---|
| Trisazo pigment having the following formula | 30 |

-continued

| | parts by weight |
|---|---|
| 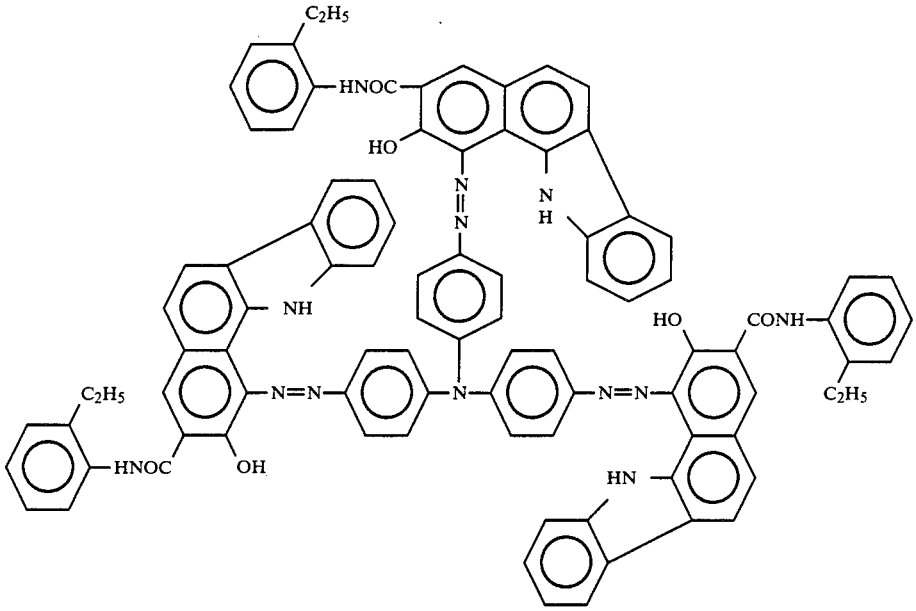 | |
| Polyester resin (Trademark "Vylon 200", made by Toyobo Co., Ltd.) | 12 |
| Cyclohexanone | 360 |

[Formation of Charge Transporting Layer]

A coating liquid for forming a charge transporting layer having the following formulation was coated onto the charge generating layer by dipping, and then dried, whereby a charge transporting layer having a thickness of approximately 20 μm was formed. The Vickers hardness of the charge transporting layer thus obtained, Hv (I), was approximately 20 Kg/mm$^2$.

| | parts by weight |
|---|---|
| 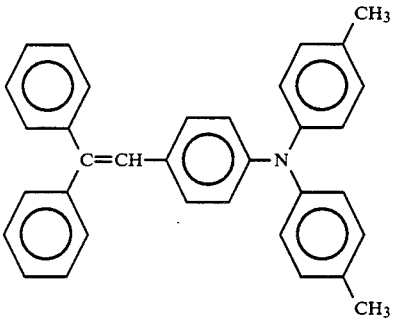 | 10 |
| Polycarbonate (Trademark "Panlite K-1400", made by Teijin Limited) | 10 |
| Silicone oil (Trademark "KF 50", made by Shin-Etsu Silicone Co., Ltd.) | 0.0002 |
| Tetrahydrofurane | 80 |

[Formation of Protective Layer]

A protective layer, having a thickness of 1 μm, made of a carbon based material was formed on the above-formed charge transporting layer by plasma CVD. The plasma CVD was conducted under the following conditions, and the apparatus used is shown in FIG. 3.

Flow rate of $NF_3$: 50 SCCM
Flow rate of $C_2H_4$ 150 SCCM
Reaction pressure: 0.02 Torr
Output power of first
alternating voltage: 400W, 13.56 MHz
Bias voltage (direct current): −80 V The protective layer thus obtained had a Vickers hardness, Hv (II), of 500 Kg/mm$^2$.

Thus, electrophotographic photoconductor No. 1-1 according to the present invention was prepared.

EXAMPLE 1-2

Example 1-1 was repeated except that the conditions for forming the protective layer employed in Example 1-1 were replaced by the following conditions, whereby electrophotographic photoconductor No. 1-2 according to the present invention was prepared.

Flow rate of $NF_3$: 50 SCCM
Flow rate of $C_2H_4$ 150 SCCM
Reaction pressure: 0.05 Torr
Output power of first
alternating voltage: 400W, 13.56 MHz
Bias voltage (direct current): −150 V The protective layer thus obtained had a Vickers hardness, Hv (II), of approximately 1500 Kg/mm$^2$, and its thickness was approximately 1 μm.

EXAMPLE 1-3

Example 1-1 was repeated except that the conditions for forming the protective layer employed in Example 1-1 were replaced by the following conditions, whereby electrophotographic photoconductor No. 1-3 according to the present invention was prepared.

Flow rate of $NF_3$: 50 SCCM
Flow rate of $C_2H_4$ 150 SCCM
Reaction pressure: 0.03 Torr Output power of first alternating voltage: 400W, 13.56 MHz
Bias voltage (direct current): −300 V The protective layer thus obtained had a Vickers hardness, Hv (II), of approximately 2000 Kg/mm$^2$, and its thickness was approximately 1 μm.

EXAMPLE 1-4

Example 1-1 was repeated except that the conditions for forming the protective layer employed in Example 1-1 were replaced by the following conditions, whereby electrophotographic photoconductor No. 1-4 according to the present invention was prepared.
Flow rate of $NF_3$: 50 SCCM
Flow rate of $C_2H_4$ 150 SCCM
Reaction pressure: 0.01 Torr
Output power of first alternating voltage: 400W, 13.56 MHz
Bias voltage (direct current): −500 V The protective layer thus obtained had a Vickers hardness, Hv (II), of approximately 2500 Kg/mm$^2$, and its thickness was approximately 1 μm.

Comparative Example

Example 1-1 was repeated except that the conditions for forming the protective layer employed in Example 1-1 were replaced by the following conditions, whereby comparative electrophotographic photoconductor was prepared.
Flow rate of $NF_3$: 50 SCCM
Flow rate of $C_2H_4$: 150 SCCM
Reaction pressure: 0.05 Torr
Output powder of first alternating voltage: 400W, 13.56 MHz
Bias voltage (direct current): −600 V The protective layer thus obtained had a Vickers hardness, Hv (II), of approximately 3000 Kg/mm$^2$, and its thickness was approximately 1 μm.

The above-prepared electrophotographic photoconductors Nos. 1-1, 1-2, 1-3 and 1-4 according to the present invention and the comparative one were evaluated in the following methods.

1. Peel off Test

The peel off test was carried out in order to evaluate the adhesion between the protective layer and the photoconductive layer of each photoconductor.

A pressure-sensitive adhesive tape (Trademark "Scotch Mending Tape 810", made by Sumitomo 3M Limited) was stuck to the surface of each photoconductor. Peeling the tape off the photoconductor, a visual observation was made as to whether or not the protective layer peeled off the photoconductive layer. The results are as shown in Table 1.

TABLE 1

| Photoconductor No. | Vickers Hardness Hv (I) (Kg/mm$^2$) | Vickers Hardness Hv (II) (Kg/mm$^2$) | ΔHv [Hv (II) - Hv (I)] (Kg/mm$^2$) | Peel off Test |
|---|---|---|---|---|
| 1-1 | 20 | 500 | 480 | O |
| 1-2 | 20 | 1500 | 1480 | O |
| 1-3 | 20 | 2000 | 1980 | O |
| 1-4 | 20 | 2500 | 2480 | O |
| Comp. | 20 | 3000 | 2980 | X |

In the above table: "0": exfoliation of the protective layer was observed; and "X": no exfoliation of the protective layer was observed.

The results of the above observation demonstrate that when the difference between the Vickers hardness of the organic photoconductive layer and that of the protective layer exceeds 2500 Kg/mm$^2$, the adhesion between these two layers is lowered. As a result, the protective layer peels off the photoconductive layer.

2. Printing Test

Each photoconductor was placed in a laser printer, and images were repeatedly and continuously printed on copying paper.

In the case where the comparative photoconductor was employed, fine crackes appeared on the protective layer when images were printed on the 2000th copying paper, and the protective layer began to peel off the photoconductive layer at its circumference. Furthermore, the printed images accompanied with offensive black lines, and finally the comparative photoconductor could not withstand the practical use.

On the other hand, the protective layers of photoconductors Nos. 1-1, 1-2, 1-3 and 1-4 according to the present invention produced no cracks, and did not peel off the photoconductive layers even when images were repeatedly and continuously printed on 20,000 sheets of copying paper. The printed images thus obtained had high quality.

After the printing on the 20,000th copying paper, the thickness of the protective layer of each photoconductor according to the present invention was measured by a precision difference gauge to determine the thickness decreased. Thus, the degree of abrasion of the protective layer was evaluated. The results are shown in Table 2.

TABLE 2

| Photoconductor No. | Thickness decreased (Å) |
|---|---|
| 1-1 | maximum 4500 |
| 1-2 | maximum 200 |
| 1-3 | maximum 100 |
| 1-4 | maximum 50 |

EXAMPLE 2-1

The surface of the organic photoconductive layer composed of the charge generating layer and the charge transporting layer prepared in the same manner as in Example 1-1 was treated by plasma generated using hydrogen.

The plasma treatment was conducted in the following method. Namely, the flow rate of $H_2$ was adjusted to 50 SCCM. Plasma was generated by the first alternating electric field with a frequency of 13.56 MHz, and a bias was applied to the plasma by the second alternating electric field with a frequency of 50 KHz. The DC constituent of the bias voltage was −100 V. Thus, oxygen existed as $O_2$ and $H_2O$ was removed from the organic photoconductive layer.

A protective layer made of a carbon-based material was then formed on the photoconductive layer by the following procedures using the apparatus shown in FIG. 3. The conditions were as follows:
Flow rate of $NF_3$: 5 SCCM
Flow rate of $C_2H_4$: 80 SCCM
Reaction pressure: 0.05 Torr
Frequency of first alternating electric field: 13.56 MHz
Output power of first alternating voltage: 400 W
Frequency of second alternating electric field: 250 KHz
Amplitude of second alternating voltage: 100 V
Direct current bias: −50 V Film formation speed: 500 Å/min A thin film, having a thickness of 0.8 μm, made of a carbon-based material which had an amorphous or crystalline structure and was transparent to infrared and visible lights was formed as the protective layer on the photoconductive layer. The specific resistance, the Vickers hardness and the optical energy band width of the protective layer were $1\times10^{13}$ Ω·cm, 1500 Kg/mm$^2$, and 2.4 eV, respectively.

Thus, electrophotographic photoconductor No. 2-1 according to the present invention was prepared, whose protective layer contained 30 atom% or less of hydrogen, 0.3 to 3 atom% of fluorine and 0.3 to 10 atom% of nitrogen. The oxygen concentration at the interface between the protective layer and the photoconductive layer was 1 atom% or less.

EXAMPLE 2-2

On a drum for use in electrostatic reproduction, an organic photoconductive layer was formed by the same procedures as in the Example 1-1. The photoconductive layer was then treated by plasma in the same method as in Example 2-1. Thereafter, a first protective layer was formed on the photoconductive layer under the following conditions:

Flow rate of $NF_3$: 5 SCCM
Flow rate of $C_2H_4$: 80 SCCM
Reaction pressure: 0.05 Torr
Frequency of first alternating electric field: 13.56 MHz
Output power of first alternating voltage: 400 W
Frequency of second alternating electric field: 250 KHz
Amplitude of second alternating voltage: 100 V
Direct current bias: −50 V
Film formation speed: 500 Å/min A thin film, having a thickness of 0.1 μm, made of a carbon-based material which had an amorphous or crystalline structure and was transparent to infrared and visible lights was formed as the protective layer on the photoconductive layer. The specific resistance, the Vickers hardness and the optical energy band width of the protective layer were $1\times10^{13}$ Ω·cm, 500 Kg/mm$^2$ and 2.4 eV, respectively.

The first protective layer was then subjected to the same plasma treatment using hydrogen as in Example 2-1. Thereafter, a second protective layer was formed on the first protective layer under the following conditions:

Flow rate of $NF_3$: 20 SCC
Flow rate of $C_2H_4$ 80 SCCM
Reaction pressure: 0.05 Torr
Frequency of first alternating electric field: 13.56 MHz
Output power of first alternating voltage: 400 W
Frequency of second alternating electric field: 250 KHz
Amplitude of second alternating voltage: 400 V
Direct current bias: −200 V
Film formation speed: 400 Å/min A thin film, having a thickness of 0.5 μm, made of a carbon-based material which had an amorphous or crystalline structure and was transparent to infrared and visible lights was formed as the second protective layer on the first protective layer. The specific resistance, the Vickers hardness and the optical energy band width of the second protective layer were $1\times10^{11}$ Ω·cm, 1800 Kg/mm$^2$ and 1.8 eV, respectively.

Thus, electrophotographic photoconductor No. 2-2 comprising two protective layers according to the present invention was prepared. The oxygen concentrations at the interfaces between the photoconductive layer and the first protective layer and between the first protective layer and the second protective layer were 1 atom% or less.

In the above Examples 2-1 and 2-2, the plasma treatment was conducted using hydrogen. However, the following methods for minimizing the oxygen concentration are also acceptable: a method of the plasma treatment accompanied by the sputtering effect which can be obtained when an inert gas such as Ar, Xe or Kr, or $N_2$ is employed, and a method of the plasma treatment accompanied by the adsorbed gas-releasing method such as heating the drum of the photoconductor to a temperature between 90 and 120° C. under a reduced pressure of $10^{-3}$ Torr or less, or allowing to stand the drum of the photoconductor for a prolonged period of time under a reduced pressure of $10^{-5}$ Torr or less.

In the electrophotographic photoconductors according to the present invention comprising an organic photoconductive layer and a protective layer made of carbon or a carbon-based material, the difference between the Vickers hardnesses of these two layers is controlled to 2500 Kg/mm$^2$ or less. Therefore, the protective layer neither peels off the photoconductive layer nor produces cracks. For this reason, high quality images can be obtained even by the photoconductor which has been used many times.

Furthermore, since the oxygen concentration at the interface or in the vicinity of the interface between the organic photoconductive layer and the protective layer, or between the intermediate layer, which is optionally interposed between the photoconductive layer and the protective layer, and the protective layer is made 1 atom% or less, the adhesion between the two layers is successfully enhanced, and the durability against the mechanical stress can be remarkably improved.

What is claimed is:

1. An electrophotographic photoconductor comprising:

an electroconductive substrate, an organic photoconductive layer formed on said electroconductive substrate, and a protective layer formed on said organic photoconductive layer, comprising carbon or a carbon-based material as its main component, with the difference between the Vickers hardness of said organic photoconductive layer and said protective layer being 2500 Kg/mm$^2$ or less.

2. The electrophotographic photoconductor as claimed in claim 1, further comprising an intermediate layer which is interposed between said organic photoconductive layer and said protective layer.

3. The electrophotographic photoconductor as claimed in claim 1, wherein the oxygen concentration at the interface or in the vicinity of the interface between said organic photoconductive layer and said protective layer is 1 atom% or less.

4. The electrophotographic photoconductor as claimed in claim 2, wherein the oxygen concentration at the interface or in the vicinity of the interface between said intermediate layer and said protective layer is 1 atom% or less.

5. The electrophotographic photoconductor as claimed in claim 1, wherein said difference in the Vickers hardness between said organic photoconductive layer and said protective layer is 2000 Kg/mm$^2$ or less.

6. The electrophotographic photoconductor as claimed in claim 1, wherein the Vickers hardness of said protective layer is 100 to 2500 $Kg/mm^2$.

7. The electrophotographic photoconductor as claimed in claim 1, wherein the Vickers hardness of said protective layer is 500 to 2000 $Kg/mm^2$.

8. The electrophotographic photoconductor as claimed in claim 1, wherein the thickness of said protective layer is 0.01 to 5 $\mu m$.

9. The electrophotographic photoconductor as claimed in claim 1, wherein said protective layer has a diamond-like structure containing the $SP^3$ orbital.

10. The electrophotographic photoconductor as claimed in claim 1, wherein the specific resistance of said protective layer is $1\times10^7$ to $1\times10^{13}$ $\Omega\cdot cm$.

11. The electrophotographic photoconductor as claimed in claim 1, wherein the optical energy band width of said protective layer is 1.0 eV or more.

12. The electrophotographic photoconductor as claimed in claim 1, wherein said protective layer is transparent to infrared light and visible light.

13. The electrophotographic photoconductor as claimed in claim 1, wherein said protective layer is composed of multiple layers.

14. The electrophotographic photoconductor as claimed in claim 1, wherein said protective layer further comprises a halogen, nitrogen, phosphorus or boron.

15. The electrophotographic photoconductor as claimed in claim 1, wherein the Vickers hardness of said organic photoconductive layer is 10 to 100 $Kg/mm^2$.

16. The electrophotographic photoconductor as claimed in claim 1, wherein the Vickers hardness of said organic photoconductive layer is 10 to 50 $Kg/mm^2$.

17. The electrophotographic photoconductor as claimed in claim 1, wherein organic photoconductive layer is a single-layer-type photoconductive layer.

18. The electrophotographic photoconductor as claimed in claim 17, wherein the thickness of said single-layer-type photoconductive layer is 5 to 30 $\mu m$.

19. The electrophotographic photoconductor as claimed in claim 1, wherein organic photoconductive layer is a function-separated-type photoconductive layer comprising a charge generating layer and a charge transporting layer.

20. The electrophotographic photoconductor as claimed in claim 19, wherein said charge generating layer comprises an azo pigment which serves as a charge generating material.

21. The electrophotographic photoconductor as claimed in claim 19, wherein the thickness of said charge generating layer is 0.01 to 5 $\mu m$.

22. The electrophotographic photoconductor as claimed in claim 19, wherein the thickness of said charge transporting layer is 5 to 100 $\mu m$.

23. The electrophotographic photoconductor as claimed in claim 1, further comprising an undercoat layer which is interposed between said electroconductive substrate and said organic photoconductive layer.

24. The electrophotographic photoconductor as claimed in claim 23, wherein the thickness of said undercoat layer is 5 $\mu m$ or less.

* * * * *

UNITED STATES PATENT AND TRADEMARK OFFICE

CERTIFICATE OF CORRECTION

PATENT NO. : 5,059,502

DATED : OCTOBER 22, 1991

INVENTOR(S) : NARIHITO KOJIMA ET AL

It is certified that error appears in the above-identified patent and that said Letters Patent is hereby corrected as shown below:

Column 1, line 16, change "a" to --as--;
line 58, change "o" to --or--.

Column 4, line 13, change "of" to --off--.

Column 9, line 62, before "1-n", insert --...,--, and after "corresponding", delete "....,".

Column 10, line 33, change "illustrate" to --illustrated--.

Column 11, line 6, change "nitrite" to --nitride--.

Column 14, lines 34 and 51, after "$C_2H_4$", insert --:--.

Column 15, line 14, after "$C_2H_4$", insert --:--.

Column 17, line 48, change "SCC" to --SCCM--;
line 49, after "$C_2H_4$", insert --:--.

Signed and Sealed this

Sixth Day of July, 1993

*Attest:*

Michael K. Kirk

MICHAEL K. KIRK

*Attesting Officer*

*Acting Commissioner of Patents and Trademarks*